US007699195B2

(12) United States Patent
Scott

(10) Patent No.: US 7,699,195 B2
(45) Date of Patent: Apr. 20, 2010

(54) APPARATUS FOR DONNING AND/OR DOFFING A COMPRESSION GARMENT AND RELATED METHODS

(75) Inventor: Edwin R. Scott, Cedar Hills, UT (US)

(73) Assignee: Julius Zorn, Inc., Cuyahoga Falls, OH (US)

( * ) Notice: Subject to any disclaimer, the term of this patent is extended or adjusted under 35 U.S.C. 154(b) by 822 days.

(21) Appl. No.: 11/260,608

(22) Filed: Oct. 27, 2005

(65) Prior Publication Data

US 2007/0119882 A1 May 31, 2007

(51) Int. Cl.
*A47G 25/80* (2006.01)

(52) U.S. Cl. ..... 223/111

(58) Field of Classification Search ..... 223/1, 223/111–119

See application file for complete search history.

(56) References Cited

U.S. PATENT DOCUMENTS 3,868,729 A * 3/1975 Lynam ..... 2/237
4,066,194 A 1/1978 Leland
4,229,833 A * 10/1980 Cox et al. ..... 2/16
4,284,216 A 8/1981 Leland
4,482,084 A 11/1984 Beskin
4,516,704 A 5/1985 Hagman
4,637,532 A 1/1987 Doorenbos
4,637,533 A 1/1987 Black
4,651,909 A 3/1987 Banting
4,708,272 A * 11/1987 Guerra ..... 223/113
4,756,453 A 7/1988 Pettit et al.
4,789,087 A 12/1988 Doorenbos
5,031,806 A 7/1991 Alpert
5,356,057 A 10/1994 Vossen
5,593,071 A 1/1997 Lusk
5,601,220 A 2/1997 Vossen
5,630,534 A 5/1997 Maier et al.
5,632,424 A 5/1997 Maier et al.
5,673,826 A * 10/1997 Stolk ..... 223/112
5,706,988 A 1/1998 Moore
5,769,289 A 6/1998 Lusk
5,799,844 A 9/1998 James
5,814,003 A * 9/1998 Knox et al. ..... 602/63
5,826,761 A 10/1998 Basaj
5,909,831 A 6/1999 Griffin
5,924,609 A 7/1999 Stolk et al.
6,032,839 A 3/2000 Joosten et al.
6,056,171 A 5/2000 Santamaria
6,234,370 B1 5/2001 Kummerle et al.
6,308,438 B1 10/2001 Throneburg et al.
6,472,590 B1 * 10/2002 Kulik ..... 84/453
6,523,729 B1 * 2/2003 Gardon-Mollard ..... 223/112
6,820,779 B1 11/2004 Wilson
6,932,252 B2 8/2005 Simmons (Continued)

*Primary Examiner*—Shaun R Hurley
*Assistant Examiner*—Andrew W Sutton
(74) *Attorney, Agent, or Firm*—Workman Nydegger

(57) ABSTRACT

An assist device for donning and/or doffing a compression garment includes a sleeve having an interior surface bounding a passage extending between a top end and an opposing bottom end, the top end including a top opening communicating with the passage, the bottom end including a bottom opening communicating with the passage, the sleeve being comprised of a sheet of flexible material. A resiliently stretchable material is secured to the bottom end of the sleeve so as to resiliently, radially constrict the sleeve thereat. A band is secured to the top end of the sleeve, the band outwardly expanding the top end of the sleeve.

13 Claims, 10 Drawing Sheets

U.S. PATENT DOCUMENTS

| | | | |
|---|---|---|---|
| 6,971,561 | B2 | 12/2005 | Sawlewicz |
| 2002/0128580 | A1 | 9/2002 | Carlson et al. |
| 2002/0139819 | A1 | 10/2002 | Ferraioli |
| 2003/0230605 | A1 | 12/2003 | Simmons |
| 2004/0104254 | A1 | 6/2004 | Klammer |
| 2004/0149789 | A1 | 8/2004 | Landsberger et al. |
| 2004/0178234 | A1 * | 9/2004 | Sawlewicz ..... 223/111 |

* cited by examiner

APPARATUS FOR DONNING AND/OR DOFFING A COMPRESSION GARMENT AND RELATED METHODS

CROSS-REFERENCE TO RELATED APPLICATIONS

Not applicable.

BACKGROUND OF THE INVENTION

1. The Field of the Invention

The present invention relates to devices and methods for donning and doffing an appendage garment. More particularly, embodiments of the present invention relate to devices and methods that assist in the donning and doffing of compression garments.

2. The Relevant Technology

Compression garments, such as calf stockings, leg stockings, and arm sleeves, are medical garments designed specifically for applying continuous pressure to an appendage such as the foot, leg, or arm. Compression garments are typically made from an elastic material that can resiliently stretch around a limb to provide compression therapy. Compression garments are commonly used in treating a variety of vascular and circulatory related conditions such as lymphedema, chronic vein insufficiency ("CVI"), post sclerotherapy, deep vein thrombosis, edema, varicose veins, spider veins and other vein disorders and diseases. Compression garments can both reduce swelling in an appendage and inhibit the progression of various venous disorders.

Because compression garments are necessarily tight fitting, one of the common complaints of compression garments is the difficult in donning and doffing the garments. This problem is further exacerbated by the fact that many people who wear compression garments are overweight, elderly, and/or suffer from arthritis. Such conditions can significantly limit the dexterity and strength commonly needed to don and doff compression garments. For example, the donning of a compression stocking requires the patient to slide the stocking over the end of the foot and pull the stocking up over the leg. Many patients are unable to either reach their foot or have insufficient strength to hold onto and pull the tight fitting garment over the foot and along the leg.

In an attempt to address the above problems, various mechanical devices have been designed that open up and expand or stretch the compression garment in order to facilitate placement onto a limb. Such mechanical devices, however, can be complicated to use and uncomfortable during the donning process. Furthermore, most mechanical devices are designed for donning a compression garment, but provide no assistance for doffing the compression garment.

In addition, in many situations it may be necessary for a patient to don and doff a compression garment several times during a single day. Conventional mechanical devices can be bulky and awkward to transport for use at needed times and locations. Still other devices have been designed for use in sliding on compression garments that have holes at both ends but cannot be used with compression garments has a closed end, such as a compression stocking have a closed toe.

Accordingly, it would be advantageous to have a device and related methods for donning and doffing compression garments which are easy and comfortable to operate, require the patient to have only minimal strength and dexterity to use, can be used with compression garments having an open or closed toe, and which can be easily transported for repeated use at different times and locations.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF EMBODIMENTS OF THE INVENTION

Figure 2:
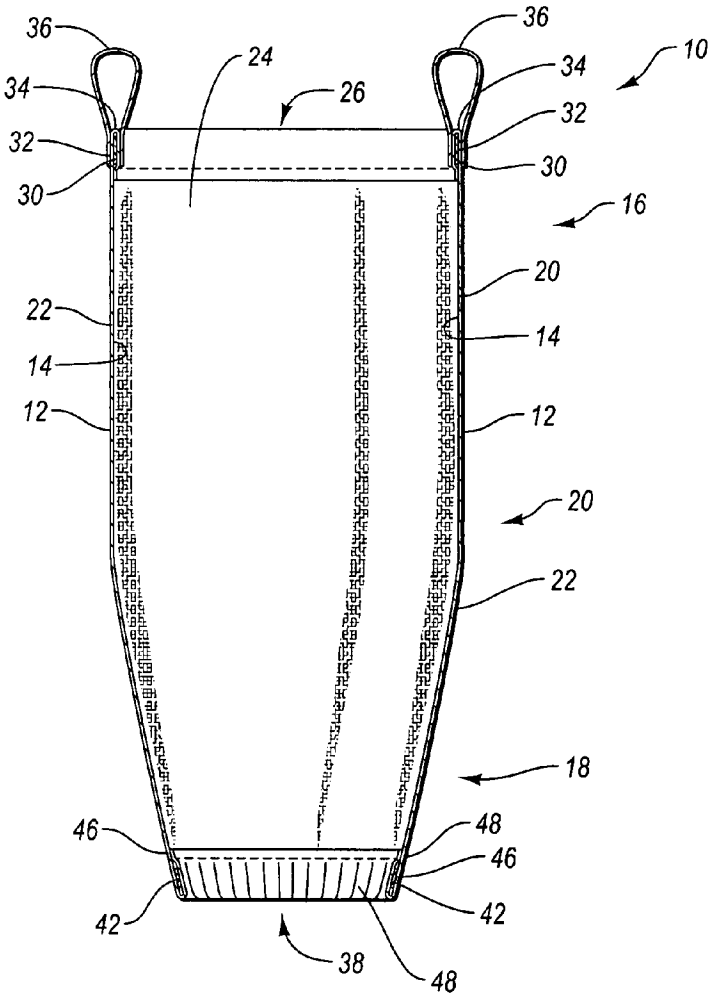
FIG. 2 is a cross-sectional side view of the donning and doffing assist device depicted in FIG. 1.
Figure 1:
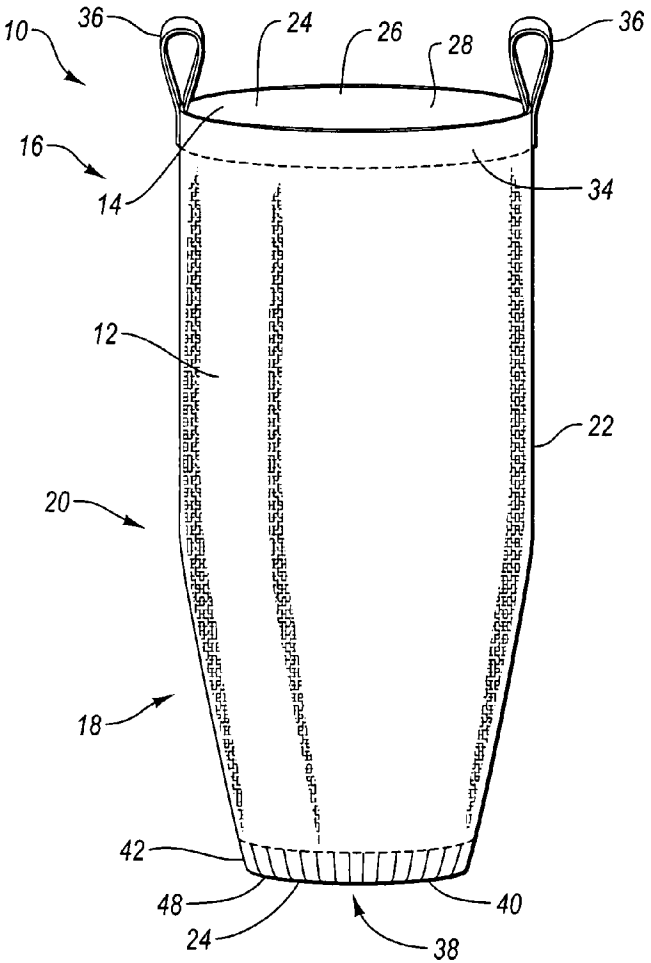
FIG. 1 is a front perspective view of one embodiment of a donning and doffing assist device.

The present invention relates to assist devices for donning and/or doffing compression garments and related methods. Depicted in FIGS. 1 and 2 is a perspective side view and a cross-sectional side view, respectively, of one embodiment of a tubular assist device 10 incorporating features of the present invention. Assist device 10 can be useful for donning and/or doffing compression garments such as those illustrated and discussed below with regard to FIGS. 3-5. The assist device 10 is comprised of a tubular sleeve 22 having an exterior surface 12 and an opposing interior surface 14 each extending between a first end 16 and an opposing second end 18. A middle portion 20 is disposed between the first end 16 and the second end 18.

The interior surface 14 bounds a passage 24 extending through tubular sleeve 22 between the first end 16 and the second end 18. A first opening 26 is formed at the first end 16 and communicates with passage 24. Likewise, a second opening 38 is formed at second end 18 and communicates with passage 24.

The tubular sleeve 22 can be made from a sheet of flexible material. For example, the sheet of flexible material can be comprised of a woven fabric, non-woven fabric, an extruded plastic or the like. When a woven fabric is used, the thread can be made of natural and/or synthetic fibers or blends thereof. An extruded tube of plastic, or sheet of plastic rolled into a tube, can be made from many different polymers known in the art. Accordingly, the tubular sleeve 22 can be comprised of many different types of materials such as rayons, viscoses, silks, polyvinyls, polyamides, spandex, polyesters, nylons, acrylics, polyolefins, polypropylenes, polyethylenes, polyacrylonitriles, cotton, other synthetic materials, and natural fibers.

As will be discussed below in greater detail, in one embodiment of the invention, the tubular sleeve 22 or the sheet of flexible material from which tubular sleeve 22 is comprised can be configured so that the interior surface 14 and/or exterior surface 12 have a low coefficient of friction. This provides the tubular sleeve 22 with a high degree of slickness so that a compression garment can easily slid over the tubular sleeve 22 and an arm or leg can easily slide into the tubular sleeve 22. In one embodiment, tubular sleeve 22 is comprised of a material having a coefficient of friction less than the coefficient of friction of the interior surface and/or exterior surface of the compression garment for which the assist device 10 is used to apply. One useful material that has been found to have the desired properties of strength, flexibility, and slickness for tubular sleeve 22 is a rip stop or rib stop woven nylon fabric. This material is typically not coated since coatings, such as: water repellant coatings, can reduce the slippery nature of the material.

In one embodiment of the present invention the tubular sleeve 22 can be secured into a continuous loop along the entire length of tubular sleeve 22. Accordingly, at least one sheet of flexible material can be rolled or looped and then affixed together along the edge so as to form a hollow tubular shape. Alternatively, a plastic material can be extruded into a continuous tubular configuration. In one embodiment the sheet of flexible material is permanently affixed together to form the tubular shape such as by stitching, adhesive, and the like. In another embodiment, means are provided for releasably securing the sheet of material into a continuous loop. By way of example and not by limitation, releasable fasteners can be used to releasably secure the flexible material into a continuous loop. Examples of releasable fasteners include a zipper, Velcro, buttons, snaps, clips, ties, loop and hook fasteners, and the like.

In alternative embodiments, it is appreciated that tubular sleeve 22 need not be connected in a continuous loop along its entire length. For example, tubular sleeve 22 can be connected together in a continuous loop at one or both opposing ends and then be unconnected therebetween. In other embodiments, tubular sleeve 22 can be connected together in a continuous radial loop at select locations along its length.

The assist device 10 can be dimensionally configured so that an appendage, such as an arm or leg of a patient can pass through passage 24. It is appreciated that tubular sleeve 22 when in an unfolded state can have a transverse cross sectional configuration having any desired geometric or irregular shape; however, a circle or loop is typical. Tubular sleeve 22 can have a substantially constant diameter along its length or can be tapered along the length thereof so as to constrict in diameter from first end 16 to second end 18.

Although tubular sleeve 22 can come in a variety of different sizes and shapes, in one embodiment tubular sleeve 22 has a maximum inner diameter in a range between about 10 cm to about 30 cm with about 10 cm to about 20 cm being more common. Likewise, tubular sleeve 22 can have a length extending between the first opening 26 and the second opening 38 in a range between about 20 cm to about 50 cm with about 30 cm to about 50 cm being more commonly. It is appreciated that the size and shape of assist device 10 can be adjusted based on the appendage it is intended to be used for and the size of the person who will be using the device. For example, the different embodiments of the assist device 10 can be sized as extra-small, small, medium, large, extra-large, etc. in order to properly fit people of different sizes. Similarly, the middle portion 20 can have an average circumference that is also variable.

In one embodiment of the present invention means are provided for holding passage 24 open at first end 16. By way of example and not by limitation, a band 30 is secured at first end 16 so as to extend about the circumference of the first end 16. Band 30 can comprise a circular or substantially circular, i.e., C-shaped, band comprised of any suitable material such as plastic, metal, composite or the like. Band 30 can have a transverse cross section that is thin and flat, circular or other desired configuration. In this regard, band 30 can simply comprise a wire. It is appreciated that band 30 can be made from a material that is rigid, non-elastic, or resiliently elastic. Use of materials that are resiliently elastic have the advantage in that band 30 can be bent or folded during use or storage but will automatically return to the desired configuration for subsequent use.

Band 30 can be secured to the exterior surface 12, interior surface 14, or disposed within an annular pocket 32 formed on tubular sleeve 22. For example, first end 16 of tubular sleeve 22 can be folded over onto itself and then stitched or otherwise secured in place so as to form annular pocket 32. Band 30 can thus be secured within pocket 32. By being captured within pocket 32, band 30 can be formed from a material that resiliently wants to radially outwardly expand first end 16 to the open position. For example, band 30 can be designed to resiliently return to a linear, circular, or any other configuration that would outwardly stretch first end 16 of tubular sleeve 22.

In the depicted embodiment, the band 30 is disposed adjacent to the first opening 26. In alternative embodiments, however, the band 30 can be secured to tubular sleeve 22 at a distance spaced apart from first opening 26 and closer to second end 18. As discussed below in greater detail, although band 30 produces some unique benefits for the present invention, in alternative embodiments assist device 10 can be formed without band 30.

Although not required, the first end 16 can also include at least one handle 36 secured thereto. In the embodiment depicted in FIGS. 1 and 2, the assist device 10 includes two loop handles 36 secured at opposing positions around the first opening 26. While loop handles 36 are shown, handles 36 can be in many different shapes and sizes in order to allow a person using the assist device 10 to be able to grip and hold onto the handles 36. As such, handles 36 can be comprised of a loop, strap, cord, ergonomic grip, or the like. Also, handles 36 can be comprised of a material that is flexible or rigid. For example, the depicted loop handles 36 are comprised of a flexible strap with one end affixed to the first end 16 on the interior surface 14 and looped about the first opening 26 with the other end affixed to the exterior surface 12 of the first end 16. In one common embodiment, handles 36 are comprised of nylon strapping that is stitched onto tubular sleeve 22. As will be discussed below with regard to operation of assist device 10, there are select advantages to having handles 36 formed from soft, flexible material.

In one embodiment of the present invention, means are provided for resiliently, radially inwardly constricting, second end 18 of tubular sleeve 12. As a result, passage 24 at second end 18, which may or may not comprise second opening 38, can selectively move between a relaxed constricted position and an expanded outwardly stretched position when an outward force is applied thereto. When in the relaxed constricted position, the circumference of second end 18 and/or second opening 38 can be smaller than or the same size as the circumference of the appendage of a patient that is to receive a compression garment. On the other hand, when in the expanded position, the circumference of second end 18 and/or second opening 38 can be the same size or larger than the circumference of the appendage. Similar to the first end 16 and/or the first opening 26, the circumference of second end 18 and/or the second opening 38 can also be configured and adjusted to accommodate the variance in circumferences between a leg and an arm or between different people.

In one embodiment of the means for resiliently, radially inwardly constricting second end 18 of tubular sleeve 12, a resiliently stretchable material 42 is secured to tubular sleeve 22 at second end 18. In the embodiment depicted, stretchable material 42 encircles second opening 38. Stretchable material 42 can be in a continuous loop that extends the circumference of tubular sleeve 22 or can extend around only a portion of the circumference of tubular sleeve 22. Examples of elastic materials 42 can include, by way of example and not by limitation, rubber, elastomeric polymers, elastic strapping, elastic bands, bungee cord, spandex-like fabrics made from elastomeric polymers (e.g., polyurethane) as well as many other elastic materials known in the art.

The elastic material 42 can be disposed adjacent to the second opening 38 or can be spaced back a distance toward first end 16. The elastic material 42 can be secured to the exterior surface 12, interior surface 14, or freely disposed within a pocket 46 that encircles passage 24 and retains the elastic material 42. For example, second end 18 of tubular sleeve 22 can be folded over onto itself and then stitched or otherwise secured in place so as to form annular pocket 46. Stretchable material 42 can thus be secured within pocket 46 in the form of a continuous loop.

In one frame of reference, the first end 16 of the assist device 10 can also be referred to as a top end 16, without limiting the orientation of the assist device, where the "top" terminology can be helpful in describing the features of embodiments of the invention. Accordingly, the first opening 26 of the assist device 10 can also be described as a top opening 26. Similarly, opposing "bottom" terminology can be used so that the second end 18 of the assist device 10 can be referred to as a bottom end 18, and the second opening 38 can be referred to as a bottom opening 38.

Figure 5:
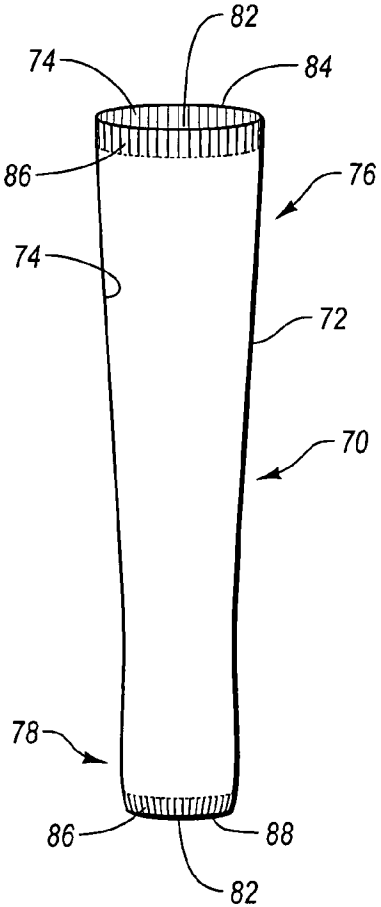
FIG. 5 is a perspective of one embodiment of an arm sleeve compression garment.
Figure 4:
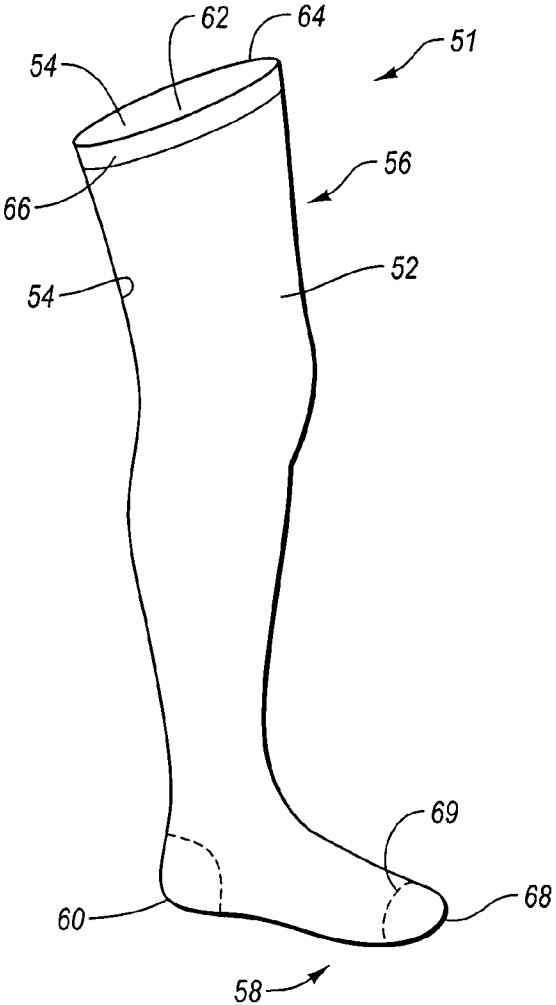
FIG. 4 is a perspective of one embodiment of a leg stocking compression garment.
Figure 3:
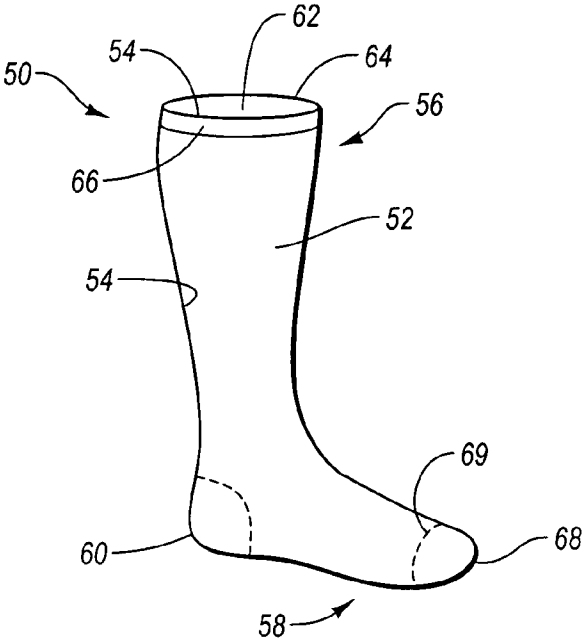
FIG. 3 is a perspective view of one embodiment of a calf stocking compression garment.

Depicted in FIGS. 3-5 are examples of compression garments that are specifically designed to be used in treating a variety of vascular and circulatory related conditions such as lymphedema, chronic vein insufficiency ("CVI"), post sclerotherapy, deep vein thrombosis, edema, varicose veins, spider veins and other vein disorders and diseases. The compression garments are typically made from a flexible, elastic material that can resiliently stretch around a limb to provide the desired compression therapy. Typical compression garments are made from a material that includes polyamides and spandex. Other resiliently stretchable materials can also be used. Natural fibers such as cotton can be included as desired or needed for people with allergies or sensitive skin. The material is commonly a durable and breathable knit for easy care and comfort. Also, the material can be sheer and/or have a silky smooth softness against the skin.

The compression garments need to have sufficient strength and resilient properties that they can radially inwardly compress the appendage over which they are received to the extent necessary to effectively treat the related disorder. In one embodiment, the compression garments are designed to apply a compression force of at least 20 mm of Hg while in other embodiments the compression garments can apply at least 30 mm of Hg or at least 40 mm of Hg. The desired compression force is typically in a range between about 20 mm of Hg to about 60 mm of Hg.

Depicted in FIGS. 3 and 4, a compression garment can be in the form of a calf stocking 50 or a leg stocking 51, both being in substantially the shape of a tube. Both the calf stocking 50 and the leg stocking 51 have substantially identical components with only the length of the leg stocking 51 being longer than the calf stocking 50. However, the leg stocking 51 can have more anatomical contours compared to the calf stocking 50. As such, these embodiments of the compression garment can be discussed simultaneously.

Accordingly, each compression garment includes an exterior surface 52 and an opposing interior surface 54. The exterior surface 52 and interior surface 54 each extend the length of the calf stocking 50 or leg stocking 51 between a first end 56 and a second end 58. A heel portion 60 can optionally be configured for fitting onto a heel of a person wearing the calf stocking 50 or leg stocking 51. The exterior surface 52 and interior surface 54 define the shape of the calf stocking 50 or leg stocking 51, where each can include various anatomical curvatures. The interior surface 54 further bounds a channel 62 extending between the first end 56 and the second end 58.

The first end 56 includes a first opening 64 that communicates with the channel 62 extending the length of the calf stocking 50 or leg stocking 51. Also, the first opening can be bounded by a band 66 extending along the circumference of the first opening 64. The band 66 can include material that grips the skin to aid in holding the first end 56 in place while the compression garment is being worn. The second end 58 includes a terminal end 68. As depicted by FIGS. 3 and 4, the terminal end 68 can be a closed end. Alternatively, a second opening identified by dashed lines 69 can be formed at terminal end 68 so as to communicate with channel 62.

FIG. 5 depicts an arm sleeve 70 compression garment in substantially the shape of a tube. The arm sleeve 70 is comprised of an exterior surface 72 and an opposing interior surface 74. The exterior surface 72 and interior surface 74 extend the length of the arm sleeve 70 between a first end 76 and a second end 78. The exterior surface 72 and interior surface 74 define the shape of the arm sleeve 70. The arm sleeve 70 can be comprised of a flexible and resiliently stretchable material substantially the same as the materials used in the calf stocking 50 and leg stocking 51 as previously discussed. Additionally, the interior surface 74 bounds a channel 82 extending between the first end 76 and the second end 78.

The first end 76 includes a first opening 84 that communicates with the channel 82 extending the length of leg stocking 70. Also, the first opening 84 can be bounded by a band 86 extending along the circumference of the first opening 84. The second end 78 includes a second opening 88 that communicates with the channel 82 extending the length of the arm sleeve 70. Additionally, the second opening 88 can be bounded by a band 86 extending along the circumference of the second opening 88. Each band 86 can be comprised of a resiliently elastic material to hold the arm sleeve 70 in place while being worn.

Figure 6:
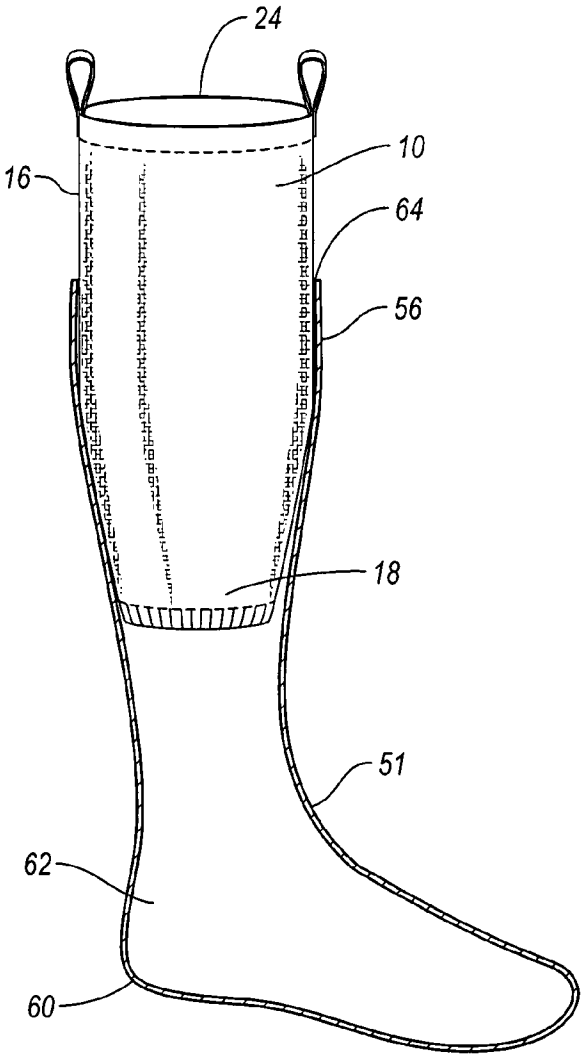
FIG. 6 is a cross sectional side view of the assist device shown in FIG. 1 being inserted into the leg stocking compression garment of FIG. 4.
Figure 7:
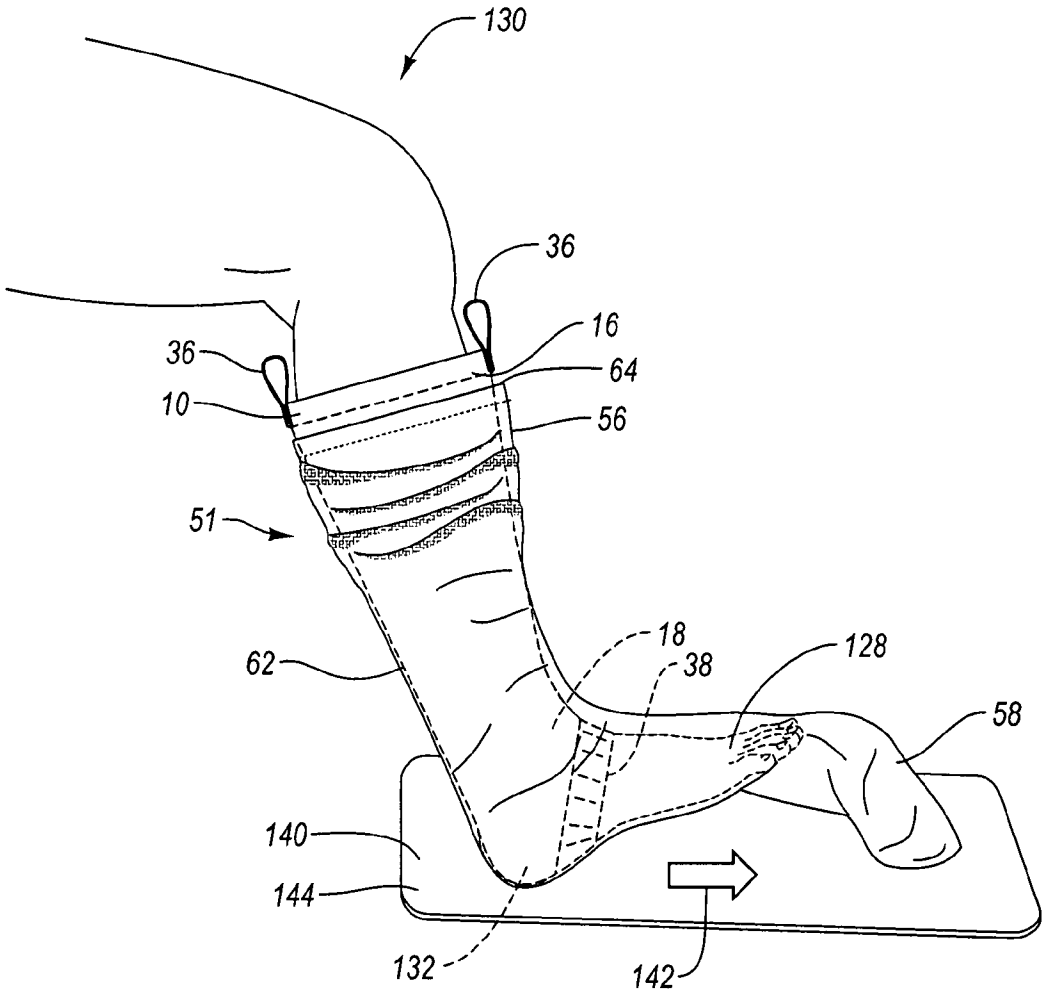
FIG. 7 is a perspective side view of the system shown in FIG. 6 being partially positioned on the lower end of a leg.

As previously mentioned, assist device 10 can be used for donning and/or doffing a compression garment such as calf stocking 50, leg stocking 51, arm sleeve 70, or the like. By way of illustration, depicted in FIG. 6, assist device 10 is shown being used for donning leg stocking 51. Initially, while holding assist device 10 and leg stocking 51, second end 18 of assist device 10 is manually inserted into channel 62 of leg stocking 51 through first opening 64. Although second end 18 of assist device 10 can be positioned at a variety of different locations within channel 62, in one typical embodiment, second end 18 is positioned at or adjacent to heal portion 60. In other uses, second end 18 can be positioned before or advanced past heal portion 60. Assist device 10 is typically positioned so that first end 16 is disposed outside of leg stocking 51. As such, it is sometimes necessary to gather or fold over first end 56 of leg stocking 51 as assist device 10 is being inserted therein.

Where the patient has sufficient dexterity, the patient can then insert their foot into passage 24 of assist device 10 from first end 16 while holding onto assist device 10 and/or leg stocking 51. Where the patient has insufficient dexterity, the patient can simply drop the combined assist device 10 and leg stocking 51 onto the floor. The user can then simply slide their foot into passage 24 of assist device 10 from first end 16 without holding onto assist device 10 and/or leg stocking 51. As a result of band 30 (FIG. 2) holding first end 16 of assist device 10 open, it is easy for the patient to slid their foot into passage 24. However, to prevent the combined assist device 10 and leg stocking 51 from sliding away from the patient, leg stocking 51 can be rested on a surface that grips leg stocking 51. By way of example and not by limitations, as depicted in FIG. 7, a mat 140 can be use that is made from neoprene, rubber, or any other material that will grip leg stocking 51 as the patient's foot is slid therein.

Once the patient has placed their foot 128 within assist device 10, the patient can continue to manipulate their foot 128 so as to advance the patient's foot and assist device 10 further into leg stocking 51, thereby advancing leg stocking 51 onto the leg 130 of the patient. Specifically, as depicted in FIG. 7, mat 140 has a top surface 144. The patient places the heel 132 of their foot 128 on top surface 144 of mat 140 with the toes slightly raised. While pushing down, the patient slides the heel 132 forward along mat 140 in the direction of arrow 142. Because of the engagement between leg stocking 51 and mat 140, leg stocking 51 remains relatively stationary relative to mat 140. However, because assist device 10 is slick and freely slides on leg stocking 51, assist device 10 and the patient's foot 128 slide relative to leg stocking 51 within channel 62 thereof.

The patient can continually repeat the sliding process multiple time to progressively advance the leg 130, foot 128 and assist device 10 farther into leg stocking 51. This process can be accomplished without the patient holding onto assist device 10 and/or leg stocking 51. Alternatively, where the patent has sufficient flexibility, the patient can assist with the advancement by holding onto assist device 10 and/or leg stocking 51. It is appreciated that mat 140 is not required and that other conventional surfaces, such as a carpeted floor, can also be used as the gripping surface.

During the donning process, the constricting of second end 18 of assist device 10 using elastic material 42 (FIG. 2) can have a number of advantages. For example, as the patient initially places their foot 128 into assist device 10, the patient can catch second end 18 of assist device 10 with their toes by catching their toes on the inside of the elastic material 42. This enables the patient to help slide assist device 10 within leg stocking 51. In turn, by manipulating the toes so that they extend through second opening 38, further sliding of heal along mat 140 causes assist device 10 to progressively slide back along the foot 128. The rearward progression of assist device 10, however, is slower than the rearward sliding of leg stocking 51 which slides against assist device 10. Elastic material 42 helps to catch and hold second end 18 of assist device 10 around the foot 128 at a location distal of heal 132 as depicted in FIG. 7. Thus, assist device 10 can be maintained over heal 132 while leg stocking 51 is progressively advanced onto leg 130.

After the patient has advanced their foot 128 to the desired location at the end of leg stocking 51, remainder of leg stocking 51 is primarily gathered around the ankle and lower calf of the patient while still encircling assist device 10. Because assist device 10 has now advanced higher along leg 130, the patient can now more easily bend over and grab assist device 10 and more notably handles 36. By pulling up on handles 36, assist device 10 slides up the calf of the patient drawing up leg stocking 51 therewith. Because of the slippery properties of assist device 10, using assist device 10 to pull up leg stocking 51 is much easier than trying to pull up leg stocking 51 by itself.

Figure 9:
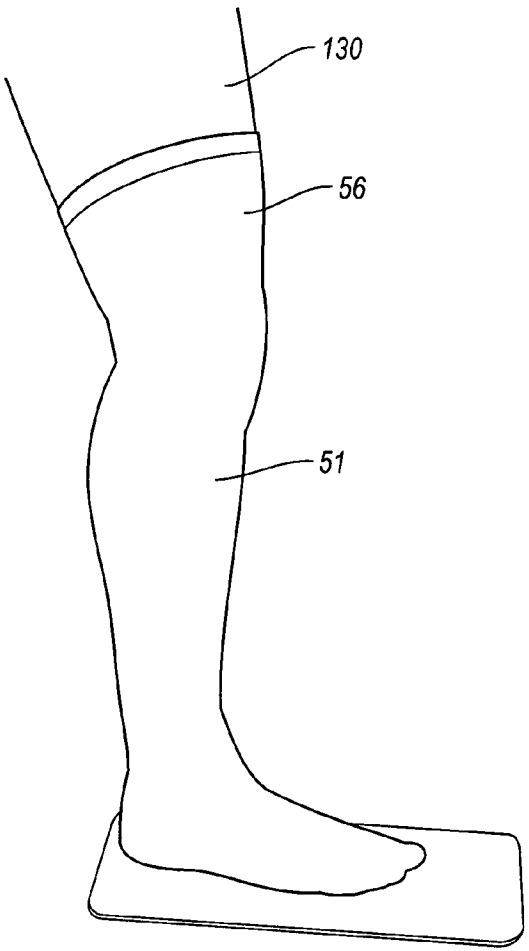
FIG. 9 is a perspective side view of the leg stocking shown in FIG. 8 being fully donned on the leg.
Figure 8:
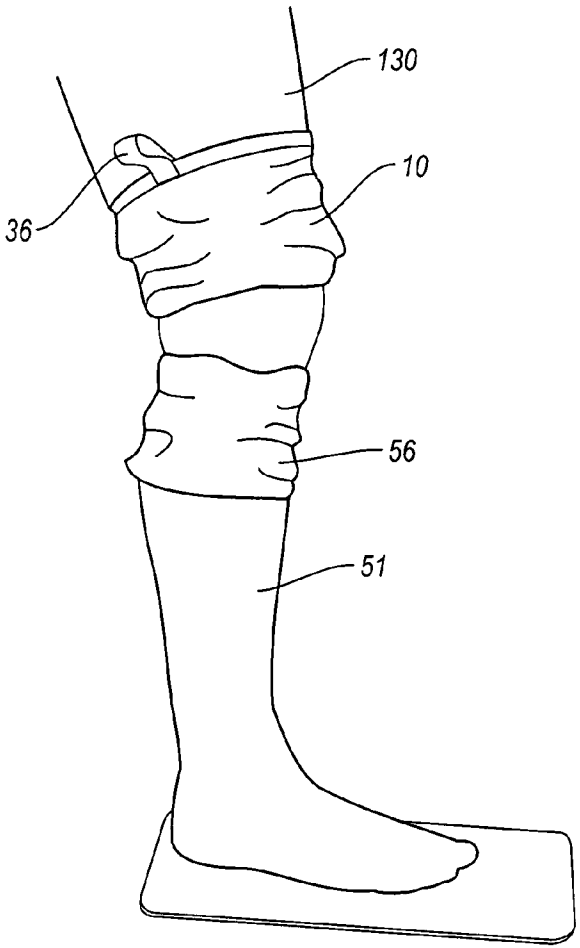
FIG. 8 is a perspective side view of the leg stocking positioned on the leg shown in FIG. 7 with the assist device begin separated therefrom on the leg.

Once, leg stocking 51 has been pulled up high on the calf or even over the knee and onto the femur using assist device 10, first end 56 of leg stocking 51 can be inverted and folded down over itself. Assist device 10 can then be pulled up higher so that leg stocking 51 is no longer covering any portion of assist device 10 as depicted in FIG. 8. Assist device 10 can then be removed from the leg 130 of the patient by simply sliding assist device 10 over leg stocking 51 and off of the leg 130. Alternatively, where assist device 10 is held in a continuous loop by one or more releasable fasteners, such as Velcro, the releasable fastener(s) can be released and assist device 10 removed from around the leg. Once assist device 10 is removed, leg stocking 51 can be pulled upward back over itself again so as to complete its full and proper donning as depicted in FIG. 9. The above process is substantially the same for donning calf stocking 50.

It is appreciated that the above donning process can be accomplished in a variety of different stages and techniques based on the physical capabilities and preferences of the user. For example, how far assist device 10 is initially inserted into leg stocking 51, how far the patient slides their foot into assist device 10 and leg stocking 51 before beginning to manually pull up on assist device 10, and when and how often the patient pulls up on or otherwise manually adjusts assist device 10 are largely based on the preference of the user.

Figure 10:
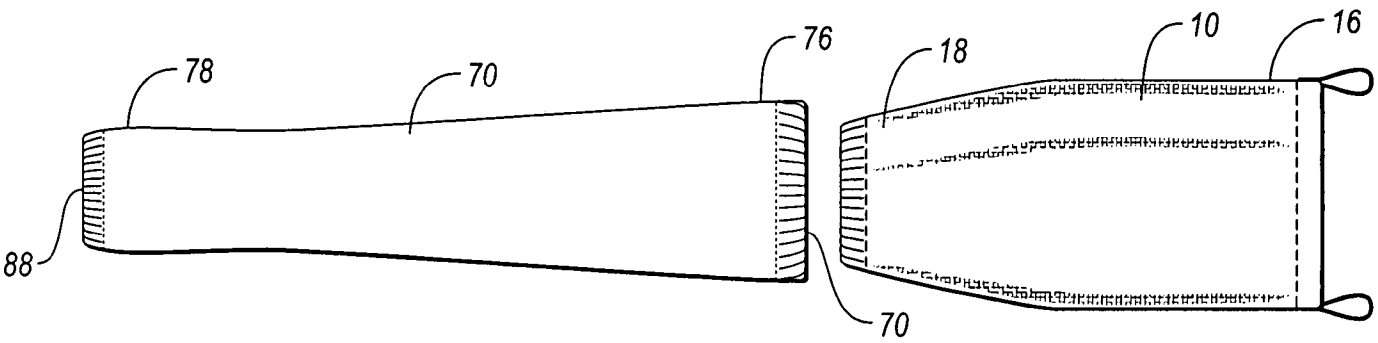
FIG. 10 is a top plan view of the arm sleeve compression garment shown in FIG. 5 and the assist device shown in FIG. 1.
Figure 11:
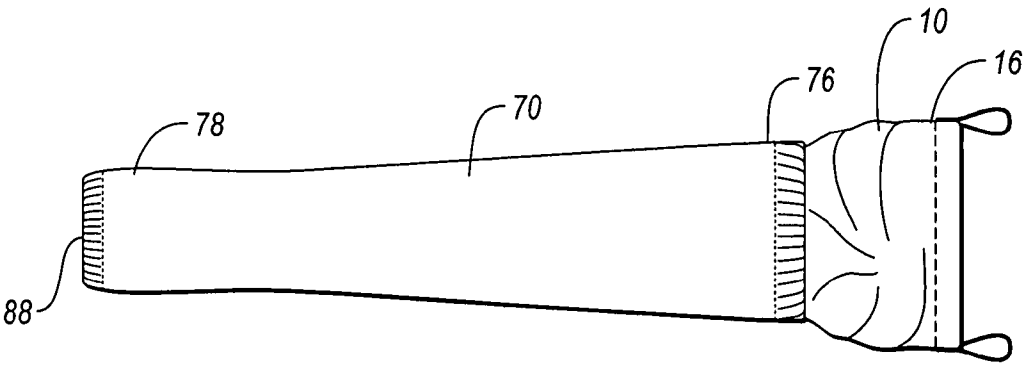
FIG. 11 is a top plan view of the assist device of FIG. 10 being positioned within the arm sleeve.

Depicted in FIGS. 10-13 is one embodiment of a method for donning arm sleeve compression garment 70 on an arm 136 of a patient using tubular assist device 10. Initially, as depicted in FIGS. 10 and 11, second end 18 of assist device 10 is inserted into channel 82 of arm sleeve 70 at first end 76. Second end 18 of assist device 10 is typically positioned at or toward second end 78 of arm sleeve 70 or can be passed out through second opening 88. The remainder of arm sleeve 70 is typically gathered so as to encircle assist device 10. First end 16 of assist device 10 is typically disposed outside of first end 76 of arm sleeve 70 but can be positioned within arm sleeve 70 at first end 76.

Figure 12:
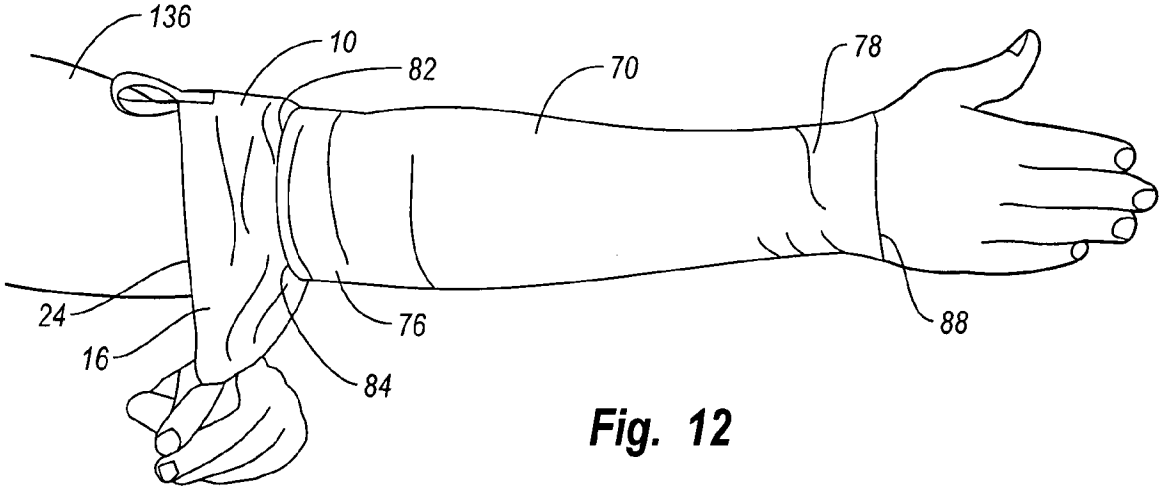
FIG. 12 is a perspective view of the system shown in FIG. 11 partially mounted on an arm.

In the above position, the patient passes their hand through first end 16 of assist device 10. The other hand of the patient is then used to pull assist device 10 up the length of arm 136. As assist device 10 is pulled up arm 136, the encircling arm sleeve 70 is automatically pulled up with assist device 10 as depicted in FIG. 12. If desired, the patent can also simultaneously grab first end 76 of arm sleeve 70 and pull on it concurrently with assist device 10. Again, because of the slippery nature of assist device 10, assist device 10 slides much easier on arm 136 than arm sleeve 70 by itself. Thus, by using assist device 10, arm sleeve 70 can be slid onto arm 136 much easier than not using assist device 10.

In an alternative method, the patient can initially insert their arm 136 through channel 24 of assist device 10 from first end 16 to second end 18. While gripping second end 18, the patient can then pull arm sleeve 70 over assist device 10 and up along arm 136. Because of the slippery nature of assist device 10, arm sleeve 70 can be relatively easily slid up and over arm 136.

Figure 13:
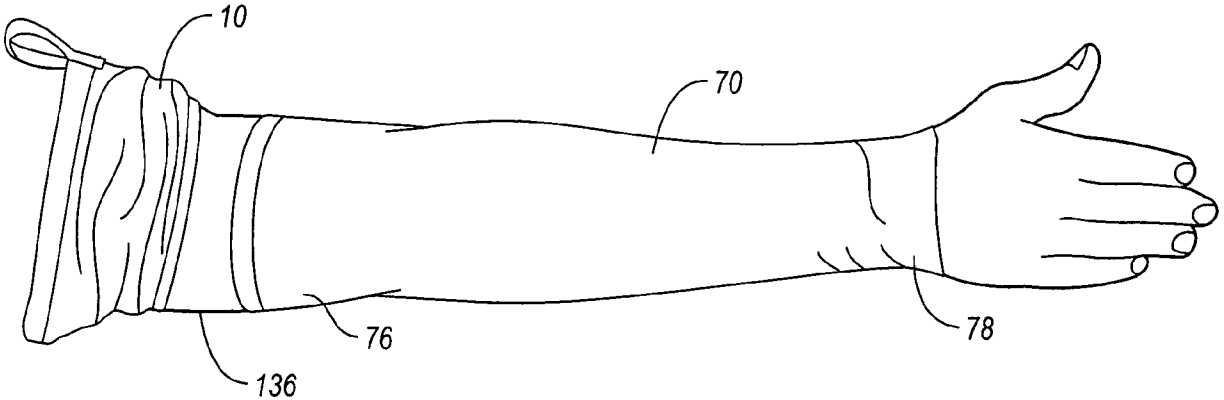
FIG. 13 is a perspective view of the system shown in FIG. 12 with the arm sleeve being fully mounted on the arm.

To complete the donning, the patient can simply continue to pull up on assist device 10 until all of assist device 10 pulls out from under arm sleeve 70 as depicted in FIG. 13. Assist device 10 can then be slid over arm sleeve 70 and off of arm 136. Alternatively, once arm sleeve 70 is pulled up along arm 136, first end 76 of arm sleeve 70 can be inverted and folded back over arm sleeve 70 a distance so that assist device 10 is no longer covered by arm sleeve 70. If needed, assist device 10 can also be further pulled out from under the folded back arm sleeve 70. Again, assist device 10 can then be slid over arm sleeve 70 and be removed off of arm 136. First end 76 of arm sleeve 70 can then be pulled up so as to complete the donning of arm sleeve 70.

Figure 15:
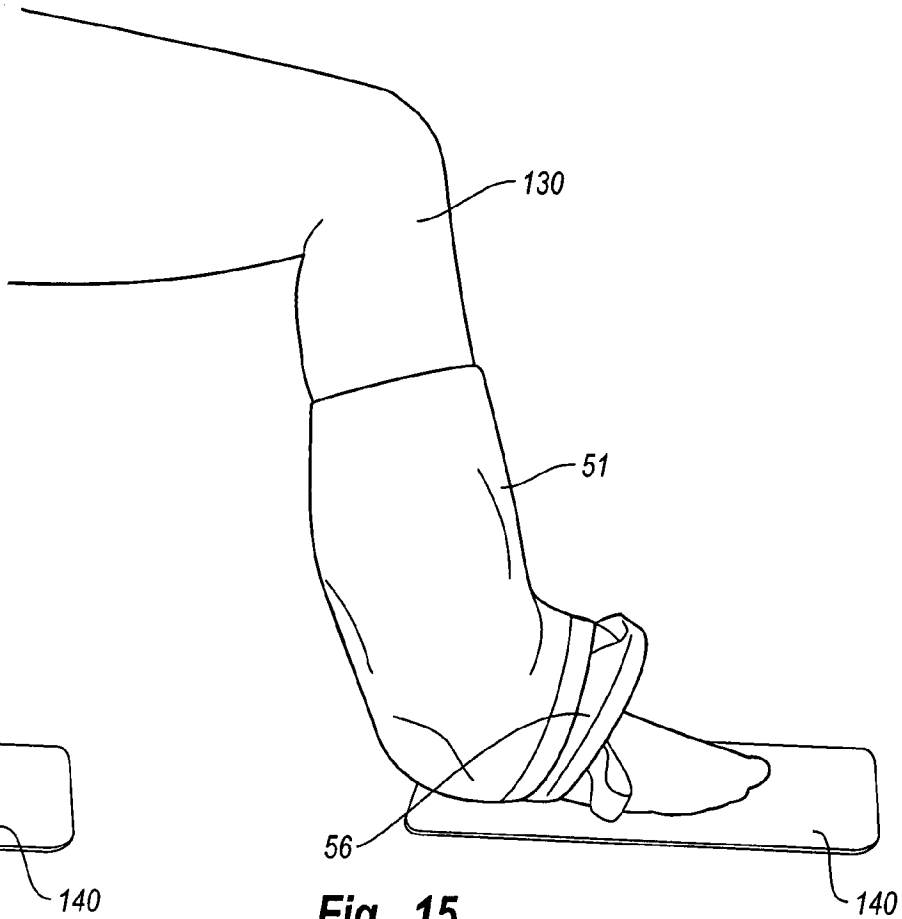
FIG. 15 is a perspective view of the system shown in FIG. 14 with the leg stocking being partially doffed.
Figure 14:
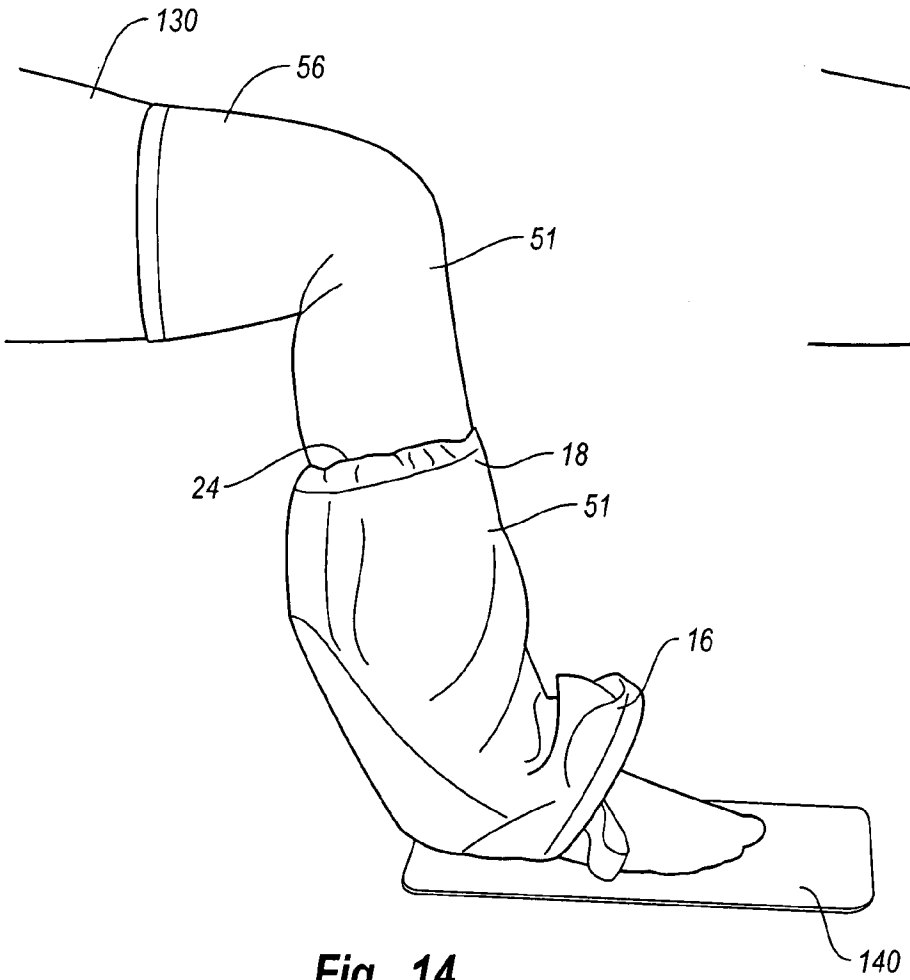
FIG. 14 is a perspective view of the assist device mounted on the leg stocking shown in FIG. 9 for doffing the leg stocking.
Figure 16:
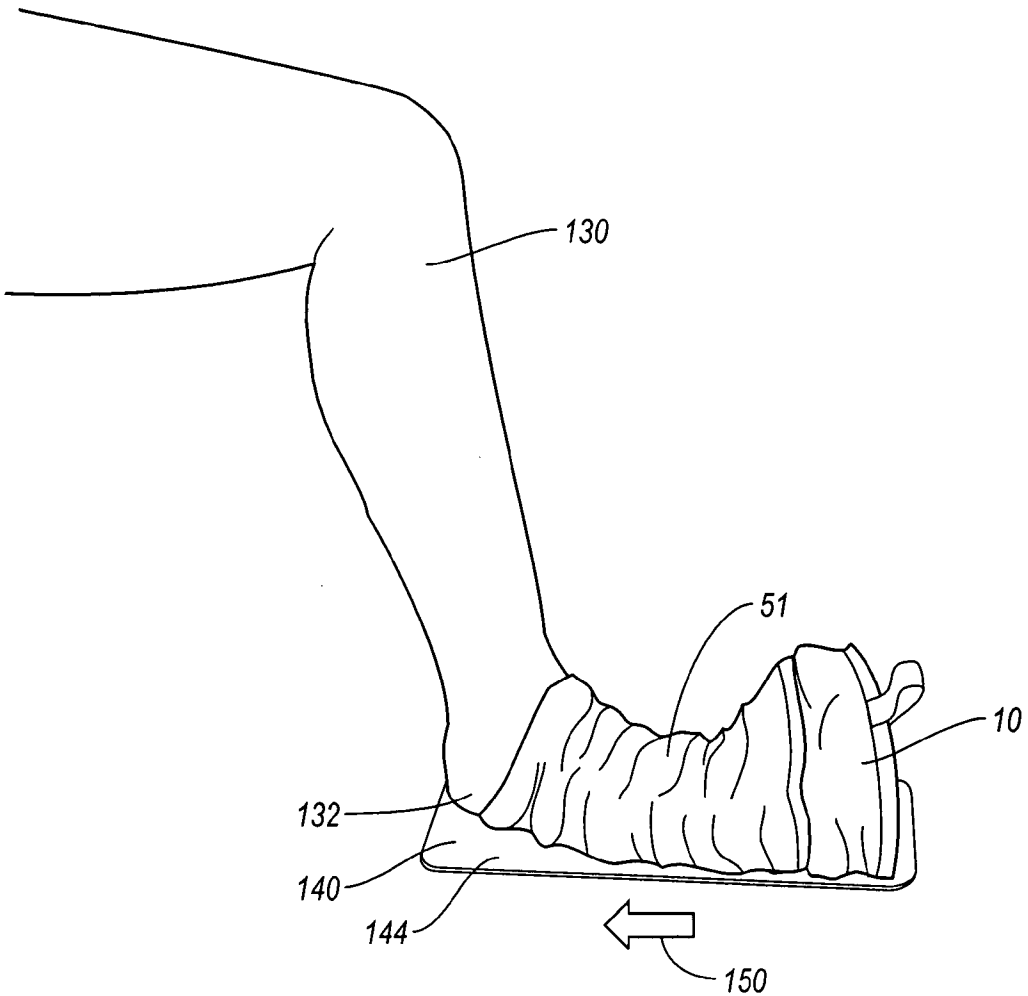
FIG. 16 is a perspective view of the system shown in FIG. 15 with the leg sleeve being substantially doffed.

Assist device 10 can also be used for the removal or doffing of a compression garment. For example, depicted in FIGS. 14-16 is one method for using assist device 10 in the doffing of leg stocking 51. Initially, the patient having leg stocking 51 received on leg 130 passes tubular assist device 10 onto leg 130. Specifically, leg 130 is passed through passage 24 of assist device 10 so that second end 18 of assist device 10 is encircling the calf or lower leg and first end 16 is positioned distal of the heal of the foot as shown in FIG. 14. Here it is noted that stretchable material 42 (FIG. 1*b*) located at second end 18 of assist device 10 constricts around the calf to hold assist device 10 on the calf.

Next, first end 56 of leg stocking 51 is inverted and pulled down over the central portion of leg stocking 51 and second end 18 of assist device 10. First end 56 of leg stocking 51 is pulled down until it extends to or past the heal of the foot as depicted in FIG. 15.

Finally, to complete the doffing of leg stocking 51, the patient biases heal 132 against a gripping surface, such as top surface 144 of mat 140. While pushing down on heal 132, the patient drags the heal 132 backward along the direction of arrow 150 depicted in FIG. 16. Although not required, this step is typically performed while the toes of the patient are slightly elevated. As heal 132 is dragged backward, leg stocking 51 substantially sticks to top surface 144 of mat 140 so as to minimize movement therebetween. Thus, because heal 132 is moving backward while leg stocking 51 is remaining stationary, leg stocking 51 continues to invert and pass over the foot as leg 130 and foot 128 move out of leg stocking 51. During this process, assist device 10 is disposed between the folded over surfaces of leg stocking 51. The relative slippery properties of assist device 10 enable the folded over surfaces of leg stocking 51 to slide past each other so that heal 132 can slide backward. Without assist device 10, the folded over surfaces of leg stocking 51 would rub against each other as the patient pushed down on the heal 132, thereby making is significantly more difficult, if not impossible, for heal 132 to slide backward within leg stocking 51.

The above process of sliding heal 132 backward while pushing down on mat 140 is repeated until all of the leg stocking 51 is inverted and passed over heal 132. Here it is noted that the most difficult part in the conventional removal of leg stockings is getting it pulled past the heal of the foot. Once this is accomplished in the present invention, the user can manually reach down and pull off the remainder of leg stocking 51. Alternatively, the user can push the ball of the foot against mat 140 and drag it backward so as to complete the doffing of leg stocking 51.

It is appreciated that assist device 10 has a number of benefits when used in association with donning and doffing a calf or leg stocking. For example, by using assist device 10, most of the donning and doffing process, and particularly more of the most difficult aspects of it, can be accomplished by the patient merely manipulating their leg and/or foot without bending or hand manipulation. As such, use of assist device 10 minimizes the required hand and arm strength and dexterity needed for donning and doffing. Furthermore, because assist device 10 implements the use of leg muscles, which are typically the largest and strongest in the body, to perform the majority of the work, assist device 10 minimizes the effort needed for donning and doffing. Assist device 10 also has the advantages in that it can be used for both donning and doffing, can be used with both open and closed toe stockings, and can be easily folded and stored in a pocket or case for transport. In addition, assist device 10 reduces the total amount of effort needed to don and doff the compression garment.

Figure 17:
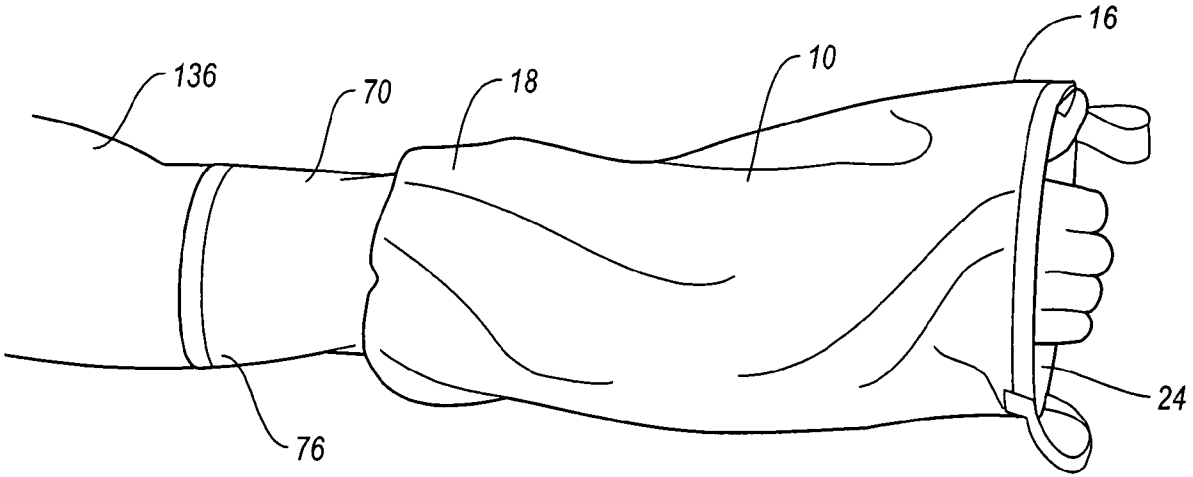
FIG. 17 is a perspective view of the assist device mounted on the arm sleeve shown in FIG. 13 for doffing the arm sleeve.
Figure 18:
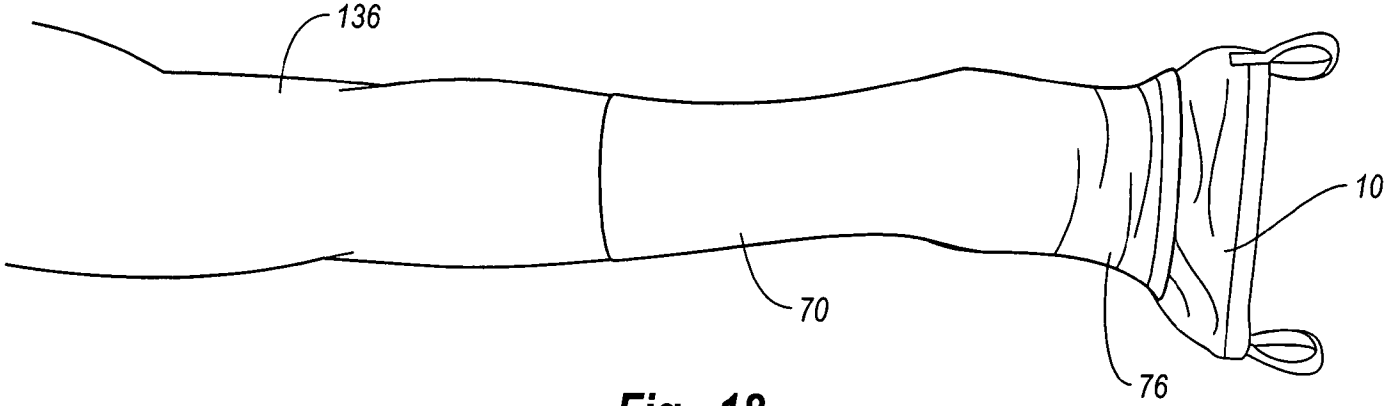
FIG. 18 is a perspective view of the system shown in FIG. 17 with the arm sleeve being partially doffed.

As depicted in FIGS. 17 and 18, assist device 10 can also be used in the doffing of arm sleeve 70. One method includes inserting arm 136 having arms sleeve 70 mounted thereon into passage 24 of assist device 10 so that second end 18 is disposed at or toward the elbow while first end 16 is disposed at or toward the hand as depicted in FIG. 17.

Next, first end 76 of arm sleeve 70 is inverted and folded over second end 18 of assist device 10 as depicted in FIG. 18. First end 76 of arm sleeve 70 is then pulled off of arm 136 by being progressively inverted and pulled over second end 78 of arm sleeve 70. Because assist device 10 is disposed between the folded over layers of arm sleeve 70, the slippery properties of assist device 10 enables the folded over surfaces of arm sleeve 70 to easily slide past each other, thereby minimizing the amount of effort to doff arm sleeve 70.

The above described methods for donning and doffing using assist device 10 are merely example of possible techniques. It is appreciated that each method can be altered and refined by the preference and physical limitations of the user.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for donning a tubular compression garment, the method comprising, in the following order:

inserting a bottom end of a tubular assist device into a channel of a tubular compression garment by passing the bottom end of the assist device through a first opening at a first end of the tubular compression garment, the tubular assist device having an interior surface bounding a passage extending through the assist device;

advancing the bottom end of the assist device within the channel of the compression garment so that the bottom end is disposed within a second end of the compression garment or so that the bottom end projects out through a second opening formed at the second end of the compression garment; and inserting a hand or foot of a user into the passage of the tubular assist device so that the compression garment encircles the hand or the foot.

2. The method in claim 1, further comprising progressing the hand or the foot completely through the passage of the tubular assist device.

3. The method in claim 1, wherein the tubular compression garment comprises a calf stocking, a leg stocking, or an arm sleeve.

4. A method of donning a tubular compression garment, the method comprising:

positioning at least a portion of a foot of a person into a passage of a tubular assist device so that the heel of the foot is disposed within the passage, the assist device being at least partially disposed within a channel of a tubular compression garment; and pushing the heel of the foot of the person across an engaging surface such that the engaging surface grips an exterior surface of the compression garment and slides at least a portion of the compression garment over the assist device disposed within the compression garment, the engaging surface being separate from the assist device and the compression garment.

5. The method in claim 4, further comprising progressing the foot completely through the passage of the tubular assist device.

6. The method in claim 4, further comprising:

moving the assist device out of the channel of the compression garment so that the assist device encircles a leg of the person and is disposed between the compression garment and a torso of the person; and removing the assist device from off of the leg by pulling the assist device over the compression garment that is still encircling at least a portion of the leg.

7. A method of donning a tubular compression garment, the method comprising:

placing an appendage of a person within a channel of a tubular compression garment, a tubular assist device being at least partially disposed within the tubular compression garment so that at least a portion of the assist device is disposed between the appendage and the compression garment, the assist device being comprised of a sheet of flexible material having an interior surface bounding a passage extending between a top end and an opposing bottom end, at least a portion of the tubular assist device forming a continuous loop that encircles the appendage;

advancing the assist device up the appendage towards a torso of the person and out from within the compression garment such that the continuous loop of the tubular assist device remains encircling the appendage; and pulling the assist device off of the appendage by passing the assist device over the compression garment that is still encircling the appendage such that the continuous loop of the tubular assist device encircles the compression garment and the appendage as the portion of the tubular assist device that forms the continuous loop is passed over the compression garment.

8. The method in claim 7, further comprising:

inserting the bottom end of the assist device into the channel of the compression garment by passing the bottom end of the assist device through a first opening at a first end of the compression garment so that a top end of the assist device protrudes from the first end of the compression garment, the bottom end of the assist device having a resiliently elastic material secured thereto so as to resiliently radially constrict the passage of the assist device thereat.

9. The method in claim 7, wherein the compression garment comprises a calf stocking, a leg stocking, or an arm sleeve.

10. The method in claim 7, wherein a second end of the compression garment is closed.

11. A method of removing a tubular compression garment from an appendage of a person using an assist device, the tubular compression garment having a channel extending from a first end to a second end, the appendage of the person being disposed within the channel at or near the second end of the compression garment, and the assist device having a passage extending from a first end to a second end, the method comprising:

inserting the appendage and compression garment into the passage at the first end of the assist device such that the first end of the assist device is disposed between the first and second ends of the compression garment;

pulling the first end of the compression garment toward the second end of the compression garment such that the first end of the compression garment passes over the first end of the assist device and extends to or past the second end of the assist device, thereby causing a first portion of the compression garment to be disposed within the passage of the assist device and a second portion of the compression garment to encircle the assist device; and pulling the first end of the compression garment further, causing the compression garment and assist device to pass over the appendage and be removed from the appendage.

12. The method in claim 11, wherein the appendage is a leg and the step of pulling the first end of the compression garment comprises pulling the heel of the foot of the leg across a surface such that the surface grips the second portion of the compression garment and causes the compression garment and assist device to pass over the foot and be removed from the leg as the heel is pulled across the surface.

13. The method in claim 4, wherein the engaging surface comprises a top surface of a mat.

* * * * *